US012145705B2

(12) United States Patent
Kawai

(10) Patent No.: US 12,145,705 B2
(45) Date of Patent: Nov. 19, 2024

(54) OUTBOARD MOTOR

(71) Applicant: HONDA MOTOR CO., LTD., Tokyo (JP)

(72) Inventor: Norikazu Kawai, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 455 days.

(21) Appl. No.: 17/692,256

(22) Filed: Mar. 11, 2022

(65) Prior Publication Data

US 2022/0289354 A1 Sep. 15, 2022

(30) Foreign Application Priority Data

Mar. 15, 2021 (JP) ..... 2021-041181

(51) Int. Cl.

| | |
|---|---|
| ***B63H 20/10*** | (2006.01) |
| ***B63H 20/32*** | (2006.01) |
| ***B63H 23/06*** | (2006.01) |
| ***B63H 23/30*** | (2006.01) |
| ***B63H 23/34*** | (2006.01) |

(52) U.S. Cl.

CPC ..... *B63H 20/106* (2013.01); *B63H 20/32* (2013.01); *B63H 23/06* (2013.01); *B63H 23/30* (2013.01); *B63H 23/34* (2013.01)

(58) Field of Classification Search

CPC ..... B63H 20/00; B63H 20/10; B63H 20/106; B63H 20/14; B63H 20/285; B63H 20/32; B63H 23/00; B63H 23/02; B63H 23/06; B63H 23/30; B63H 23/34

USPC ..... 440/61 R

See application file for complete search history.

(56) References Cited

U.S. PATENT DOCUMENTS

| | | | | |
|---|---|---|---|---|
| 7,163,427 | B1 * | 1/2007 | Lee | B63H 20/007 440/6 |
| 8,936,498 | B1 * | 1/2015 | Lee | B63H 20/007 440/62 |
| 10,981,639 | B2 * | 4/2021 | Kimpara | B63H 20/32 |

FOREIGN PATENT DOCUMENTS

| | | |
|---|---|---|
| JP | 2019-196061 | 11/2019 |

* cited by examiner

*Primary Examiner* — Lars A Olson

(74) *Attorney, Agent, or Firm* — Amin, Turocy & Watson, LLP

(57) ABSTRACT

The outboard motor includes a drive shaft 4 that extends in a vertical direction, a propeller shaft that is connected to the drive shaft 4 to intersect the drive shaft 4, an upper case 2 that accommodates the drive source, a lower case 8 that accommodates the propeller shaft, and a height adjusting unit 9 that adjusts a height position between the upper case 2 and the lower case 8. The height adjusting unit 9 includes a first member 41 that is disposed coaxially with an axis C of the drive shaft 4, a second member 42 that is fixed to the lower case 8 and is screwed to the first screw portion 48, a rotation device 43 that rotates the first member 41, and a regulating portion 44 that restricts relative rotation between the first member 41 and the second member 42.

6 Claims, 4 Drawing Sheets

OUTBOARD MOTOR

CROSS-REFERENCE TO RELATED APPLICATION

Priority is claimed on Japanese Patent Application No. 2021-041181 filed Mar. 15, 2021, the content of which is incorporated herein by reference.

BACKGROUND OF THE INVENTION

Field of the Invention

The present invention relates to an outboard motor.

Description of Related Art

In the related art, outboard motors in which in a standard posture of a usage state, a rotational output of an engine or electric motor for power is transmitted to a drive shaft disposed in a vertical direction, and rotation of the drive shaft is converted into rotation around a horizontal axis by a bevel gear to be transmitted to a propeller shaft are known. When the propeller shaft rotates, a propeller attached to the propeller shaft is rotated around the horizontal axis to propel a hull.

Here, in these outboard motors, a height position of the propeller may be changed according to a state of a water surface or intended use. At this time, if an attempt is made to adjust a height of the propeller by changing a trim angle, for example, the tilt angle also changes at the same time, which may increase a traveling resistance and affect traveling performance of a ship.

Therefore, in these outboard motors, various techniques for adjusting the height of the propeller with respect to the water surface without changing the trim angle have been proposed.

For example, in Patent Document 1 (Japanese Unexamined Patent Application, First Publication No. 2019-196061), a configuration of an outboard motor that includes a motor case accommodating a motor and a propeller shaft, a shaft connecting the motor case to an operation handle, and a shaft adjuster provided in the shaft to adjust a height position of the motor case is disclosed. The shaft adjuster has a cylindrical holder that holds the shaft slidably and a pin that is locked to one of a plurality of retaining holes formed in the shaft.

According to the technique described in Patent Document 1, the height position of the motor case can be easily adjusted by sliding the shaft with respect to the cylindrical holder.

SUMMARY OF THE INVENTION

However, in the technique described in Patent Document 1, since the height position is adjusted stepwise according to the retaining hole into which the pin is inserted, the height position of the propeller cannot be finely adjusted. Therefore, in the related art, there remains a problem in adjusting the height position from the water surface to the propeller with high accuracy.

Therefore, an object of the present invention is to provide an outboard motor capable of adjusting the height position of the propeller with high accuracy without changing the trim angle.

In order to solve the above problems, an outboard motor according to the present invention has the following configurations.

(1) According to an aspect of the present invention, there is provided an outboard motor that propels a hull by rotating a propeller with a drive source, including: a drive shaft that is connected to the drive source and extends in a vertical direction; a propeller shaft that is connected to a lower end portion of the drive shaft to intersect the drive shaft and is provided with the propeller; an upper case that accommodates the drive source; a lower case that accommodates the propeller shaft; and a height adjusting unit that adjusts a height position between the upper case and the lower case in the vertical direction, wherein the height adjusting unit includes a first member that is disposed coaxially with an axis of the drive shaft, is rotatably supported around the axis with respect to one of the upper case and the lower case, and has a screw portion coaxial with the axis, a second member that is fixed to the other of the upper case and the lower case and is screwed to the screw portion of the first member, a rotation device that rotates the first member, and a regulating portion that restricts and allows relative rotation between the first member and the second member.

(2) In the outboard motor according to the aspect (1), the height adjusting unit may change a relative height between the first member and the second member by converting rotational motion of the first member into up and down motion in the vertical direction with the screw portion.

(3) In the outboard motor according to the aspect (1) or (2), the rotation device may include a worm wheel that is disposed coaxially with the drive shaft and rotates the first member by being rotated and a worm that is meshed with the worm wheel and is connected to a motor.

(4) In the outboard motor according to any one of the aspects (1) to (3), the regulating portion may be a bolt that fastens the first member and the second member to each other.

(5) In the outboard motor according to any one of the aspects (1) to (3), the regulating portion may be a clutch that is attached to the first member and engages with the second member to make the second member non-rotatable.

(6) In the outboard motor according to the aspect (3), the worm of the rotation device may be the same as a worm in a turning unit that changes a direction of the propeller for steering the outboard motor.

According to the aspect (1), the outboard motor has the height adjusting unit that adjusts a height position between the upper case and the lower case in the vertical direction. The height adjusting unit includes the first member, the second member, the rotation device, and the regulating portion. The first member is rotatably supported around the axis of the drive shaft with respect to one of the upper case and the lower case and has a screw portion coaxial with the drive shaft. The second member is fixed to the other of the upper case and the lower case and is screwed to the screw portion of the first member. When the rotation device operates, the first member rotates relative to the second member in a state where the screw portion of the first member and the second member are screwed to each other. At this time, the rotational force of the first member is converted into the up and down motion along the axis by the screw mechanism, and the second member moves in the axial direction with respect to the first member. As a result, the height position between the upper case and the lower case in the vertical direction changes, and thus the height position of the propeller can be adjusted. Since the first member is configured to rotate coaxially with the drive shaft, the height position of the propeller can be adjusted without changing a trim angle. Since the rotational force is converted into a reciprocating motion in the upward-downward direction by the screw mechanism, the height position of the propeller can be finely adjusted to a desired height as compared with a slide type height adjusting unit of the related art. After the adjustment of the height position is completed, the height position can be fixed by restricting the relative rotation between the first member and the second member with the regulating portion.

Therefore, it is possible to provide the outboard motor capable of adjusting the height position of the propeller with high accuracy without changing the trim angle.

According to the aspect (2), the height adjusting unit changes a relative height between the first member and the second member by converting rotational motion of the first member into up and down motion in the vertical direction with the screw portion. As a result, the relative height between the upper case and the lower case can be changed. Therefore, the height position of the propeller can be adjusted to a desired height by the screw mechanism.

According to the aspect (3), the rotation device has the worm wheel and the worm. The worm wheel is disposed coaxially with the drive shaft. The worm is meshed with the worm wheel and is connected to the motor. As a result, when the worm is rotated by the motor, the worm wheel can be rotated by the worm. Therefore, the height position of the propeller can be adjusted with high accuracy by rotating the first member around the drive shaft.

According to the aspect (4), the regulating portion is a bolt that fastens the first member and the second member to each other. When the first member and the second member are fastened to each other by the bolt, the relative rotation between the first member and the second member can be restricted. Therefore, when the height of the propeller is adjusted to a desired position and then the first member and the second member are fastened to each other by the bolt, the height of the propeller can be fixed. When adjusting the height of the propeller, the height can be adjusted again simply by removing the bolt. Since the relative rotation between the first member and the second member can be restricted by the bolt, the regulating portion can have a simple configuration.

According to the aspect (5), the regulating portion is a clutch that is attached to the first member and engages with the second member to make the second member non-rotatable. By turning on and off the clutch, the height of the propeller can be adjusted and fixed. Since the clutch can be electrically controlled, the workability related to the height adjustment of the propeller can be improved as compared with a case where a bolt or the like for restricting the relative rotation between the first member and the second member is provided, for example.

According to the aspect (6), the worm of the rotation device is the same as a worm in a turning unit that changes a direction of the propeller for steering the outboard motor. Therefore, for example, in a case where the motor is driven in a state where the first member and the second member are fixed to each other by the regulating portion, the first member and the lower case can be integrally rotated with each other. That is, by rotating the worm wheel, it is possible to change a direction of the propeller and to perform turning. Therefore, the layout of the outboard motor can be simplified and the increase in cost and weight can be suppressed.

DETAILED DESCRIPTION OF THE INVENTION

Figure 1:
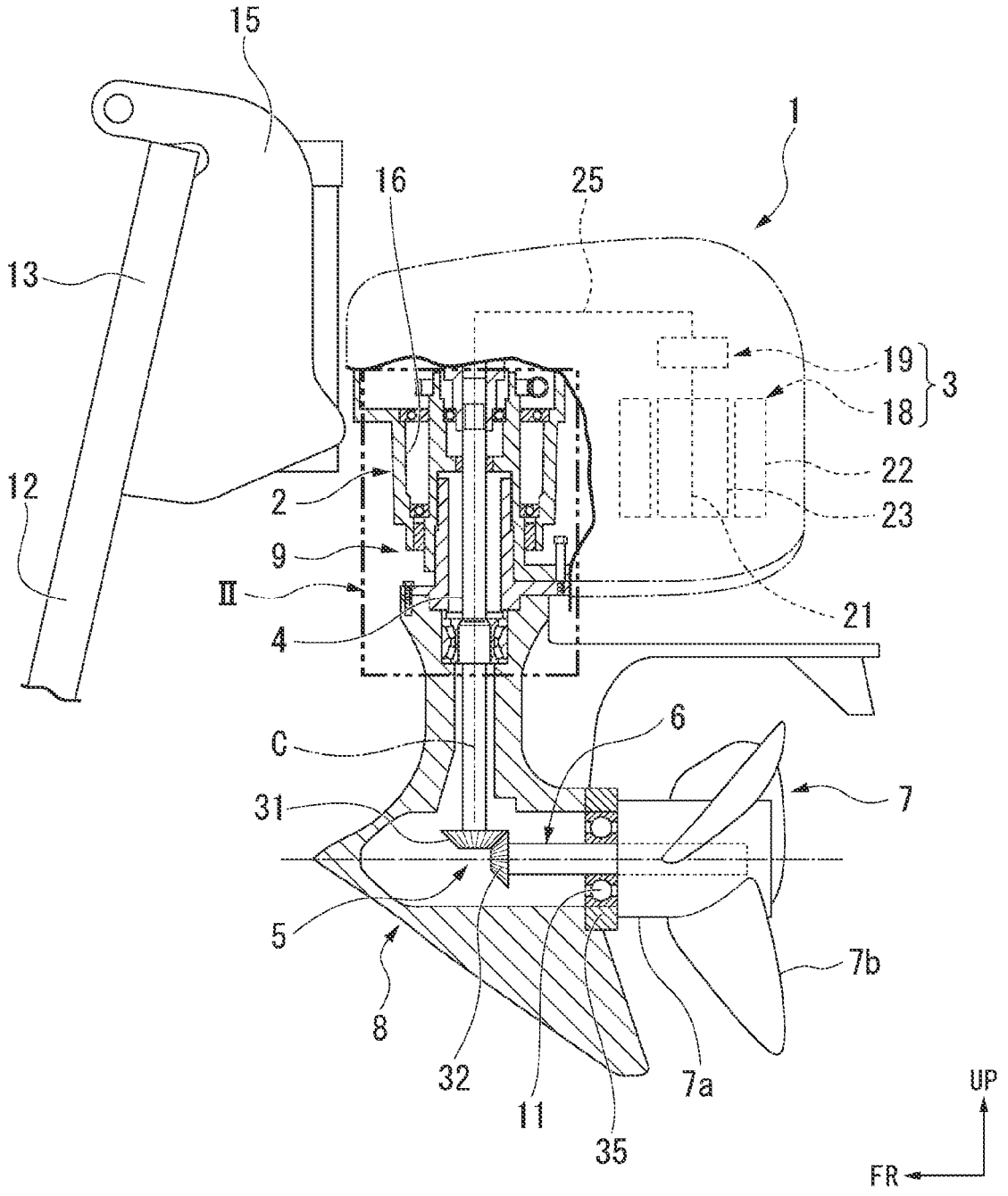
FIG. 1 is a partial cross-sectional view of an outboard motor according to a first embodiment.

Hereinafter, embodiments of the present invention will be described with reference to the drawings. FR in the drawing indicates a front side with respect to a traveling direction. UP indicates an upper side in a vertical direction. Hereinafter, a "front side with respect to the traveling direction" may be simply referred to as a "front side," and a "rear side with respect to the traveling direction" may be simply referred to as a "rear side." An "upper side in the vertical direction" may be simply referred to as an "upper side," and a "lower side in the vertical direction" may be simply referred to as a "lower side." A "forward-rearward direction with respect to the traveling direction" may be simply referred to as a "forward-rearward direction," an "upward-downward direction in the vertical direction" may be simply referred to as an "upward-downward direction", and a direction orthogonal to the "forward-rearward direction" and the "upward-downward direction" may be referred to as a "leftward-rightward direction."

Hereinafter, an outboard motor 1 of the embodiment will be described based on a standard posture in which a drive shaft 4 is disposed substantially vertically (in the upward-downward direction) and a propeller shaft 6 is disposed in the forward-rearward direction.

First Embodiment

Figure 2:
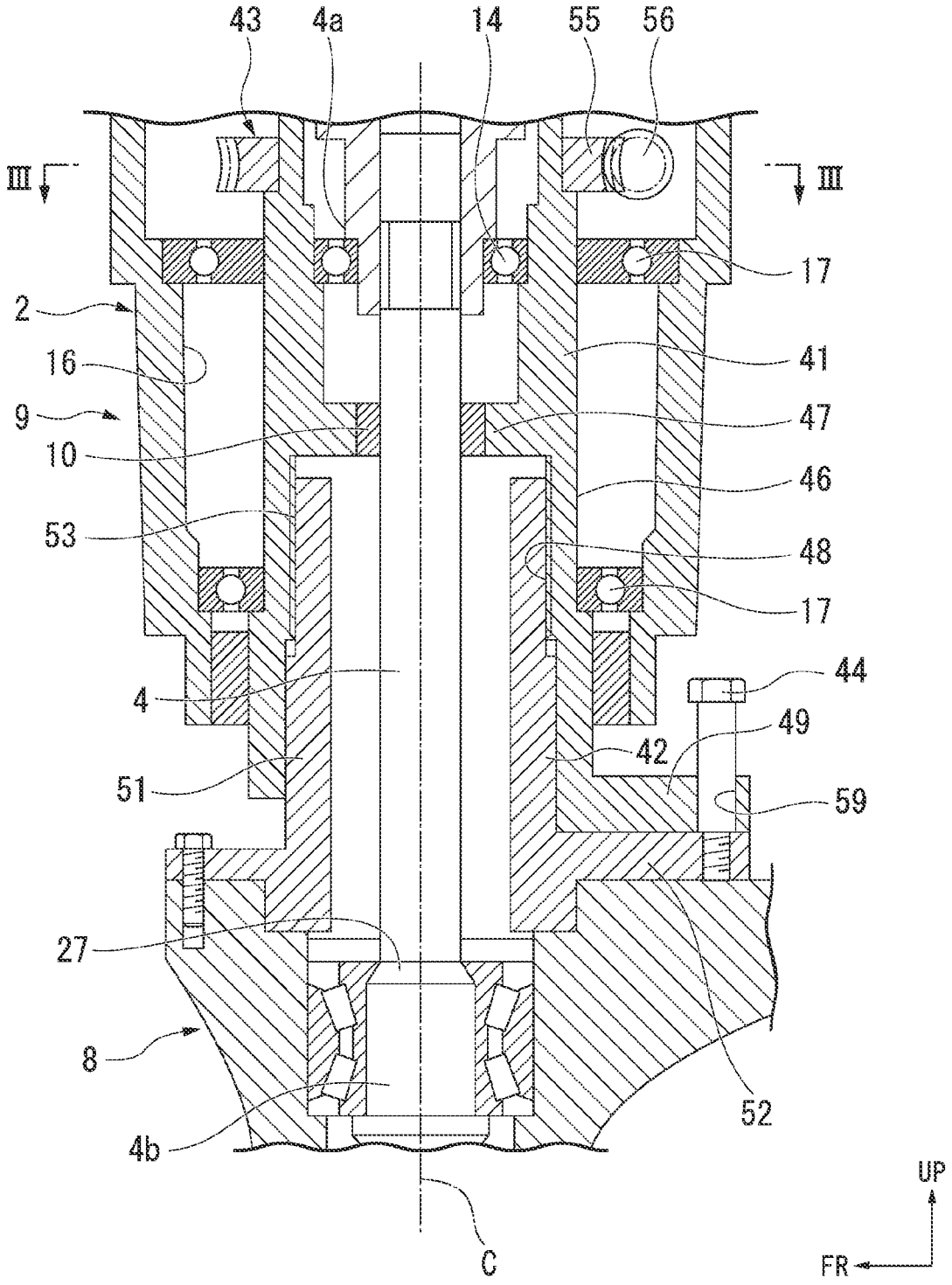
FIG. 2 is an enlarged view of part II of FIG. 1.

FIG. 1 is a partial cross-sectional view of an outboard motor 1 according to a first embodiment. FIG. 2 is an enlarged view of part II of FIG. 1.

As shown in FIG. 1, the outboard motor 1 is a propulsion device provided on a stern 13 of a hull 12 via a stern bracket 15 to propel the hull 12. The outboard motor 1 propels the hull 12 by rotating a propeller 7 with a drive source. The outboard motor 1 includes an upper case 2, a power unit 3, a drive shaft 4, a bevel gear unit 5, a propeller shaft 6, a propeller 7, a lower case 8, and a height adjusting unit 9.

The upper case 2 is provided in an upper portion of the outboard motor 1. A part of the power unit 3 and the drive shaft 4 is housed in the upper case 2. The upper case 2 is attached to the stern 13 of the hull 12 via the stern bracket 15. More specifically, the upper case 2 is attached to the stern bracket 15 to be swingably supported in the upward-downward direction via a tilt shaft (not shown) of the stern bracket 15. An oil pan (not shown) is provided at a lower portion of the upper case 2. The oil pan stores, for example, oil that cools and lubricates a drive motor 18 and a deceleration unit 19 of the power unit 3, a worm 56 of the height adjusting unit 9, and the like which will be described later.

The upper case 2 has an accommodating portion 16 that opens downward. The accommodating portion 16 is provided in the vicinity of a rear side and a lower side of the upper case 2. The drive shaft 4 can be inserted into the accommodating portion 16 from below. The accommodating portion 16 is formed in a cylindrical shape coaxial with an axis C of the drive shaft 4.

The power unit 3 is accommodated in the upper case 2. The power unit 3 includes a drive motor 18 (a drive source in the claims) and a deceleration unit 19. The drive motor 18 is an electric motor that serves as a power source for rotating the propeller 7 which will be described later. In the drive motor 18, for example, a rotation shaft 21 is disposed in the upward-downward direction, and a rotor 23 is rotatably supported inside a stator 22. The rotation shaft 21 is supported by the rotor 23, and the deceleration unit 19 is connected to the rotation shaft 21.

The deceleration unit 19 is constituted by, for example, a planetary gear mechanism (not shown). A rotational force decelerated by the planetary gear mechanism is transmitted to the drive shaft 4 through a rotational force transmission mechanism 25 to rotate the drive shaft 4. The deceleration unit 19 decelerates a rotation speed of the drive motor 18 at a predetermined deceleration ratio and transmits it to the drive shaft 4.

The drive shaft 4 extends in the upward-downward direction. The drive shaft 4 is connected to the drive motor 18 (the drive source) via the deceleration unit 19 and rotates around the axis C extending in the upward-downward direction with the rotational force from the drive motor 18. The drive shaft 4 is inserted into the accommodating portion 16 of the upper case 2 and is disposed at a distance from an inner wall of the accommodating portion 16 (see also FIG. 2). The drive shaft 4 is rotatably supported around the axis C with respect to the upper case 2 via a first member 41 which will be described later. An upper portion of the drive shaft 4 is accommodated in the upper case 2. A lower portion of the drive shaft 4 protrudes downward from the upper case 2 and extends downward to be connected to the bevel gear unit 5.

The bevel gear unit 5 is provided at a lower end portion of the drive shaft 4. The bevel gear unit 5 includes a first bevel gear 31 on an input side and a second bevel gear 32 on an output side. The first bevel gear 31 is coaxially fixed to the drive shaft 4 and is meshed with the second bevel gear 32. The second bevel gear 32 is coaxially fixed to the propeller shaft 6.

The propeller shaft 6 extends in a direction intersecting the drive shaft 4 and rearward from the second bevel gear 32. That is, the propeller shaft 6 is connected to the lower end portion of the drive shaft 4 to intersect the drive shaft 4 via the bevel gear unit 5. In the propeller shaft 6, a base end portion fixed to the second bevel gear 32 is housed in the lower case 8.

The propeller shaft 6 protrudes rearward from the second bevel gear 32 via a propeller holder 35. The propeller holder 35 is fixed to the lower case 8. For example, the base end portion of the propeller shaft 6 is rotatably supported by the propeller holder 35 via a bearing 11. A propeller 7 for propulsion is provided at a portion of the propeller shaft 6 protruding rearward from the propeller holder 35. In the propeller 7, a propeller cylinder portion 7*a* that rotates together with the propeller shaft 6 is provided with blades 7*b*. The propeller cylinder portion 7*a* extends horizontally rearward from the propeller holder 35.

The lower case 8 is provided below the upper case 2. The lower case 8 is configured separately from the upper case 2. The lower case 8 accommodates the lower portion of the drive shaft 4, the bevel gear unit 5, and the base end portion of the propeller shaft 6. The lower case 8 is configured to be movable in the upward-downward direction with respect to the upper case 2. Here, as shown in FIG. 2, the drive shaft 4 has an expansion and contraction portion 27 that expands and contracts in the upward-downward direction with the movement of the lower case 8 with respect to the upper case 2. The expansion and contraction portion 27 is provided between an upper support portion 4*a* supported by the upper case 2 and a lower support portion 4*b* supported by the lower case 8 of the drive shaft 4 in the upward-downward direction.

As shown in FIG. 1, when the drive motor 18 is driven, the rotation of the rotation shaft 21 is transmitted to the propeller 7 via the deceleration unit 19, the drive shaft 4, the bevel gear unit 5, and the propeller shaft 6. The hull 12 is propelled with the rotation of the propeller 7.

As shown in FIG. 2, the height adjusting unit 9 is provided between the upper case 2 and the lower case 8. The height adjusting unit 9 adjusts a height position between the upper case 2 and the lower case 8 in the upward-downward direction. The height adjusting unit 9 includes a first member 41, a second member 42, a rotation device 43, and a regulating portion 44.

The first member 41 is disposed in the accommodating portion 16 of the upper case 2. The first member 41 is formed in a cylindrical shape centered on the axis C. The first member 41 is rotatably supported around the axis C with respect to the upper case 2 (the inner wall of the accommodating portion 16) via a plurality of bearings 17. Further, the drive shaft 4 is rotatably supported inside the first member 41 via a bearing 14. That is, the first member 41 is disposed between the drive shaft 4 and the upper case 2 in a radial direction orthogonal to a longitudinal direction of the drive shaft 4 and is rotatably supported by each of the drive shaft 4 and the upper case 2.

The first member 41 has a cylindrical portion 46, an inner protruding portion 47, a first screw portion 48 (a screw portion in the claims), and an outer protruding portion 49.

The cylindrical portion 46 is formed in a cylindrical shape centered on the axis C.

The inner protruding portion 47 is provided at a central portion of the cylindrical portion 46 in an axial direction. The inner protruding portion 47 protrudes from an inner peripheral surface of the cylindrical portion 46 toward an inner side in the radial direction (a side of the drive shaft 4). The inner protruding portion 47 is integrally formed with the cylindrical portion 46. The inner protruding portion 47 is provided over the entire circumference of the cylindrical portion 46 in a circumferential direction. The drive shaft 4 is supported to be in sliding contact with a radial inner end portion of the inner protruding portion 47 via a sealing material 10. The bearing 14 that rotatably supports the drive shaft 4 is provided on the inner peripheral surface of the cylindrical portion 46 located above the inner protruding portion 47.

The first screw portion 48 is provided in the inner peripheral surface of the cylindrical portion 46 located below the inner protruding portion 47. In the present embodiment, the first screw portion 48 of the first member 41 is a female screw coaxial with the axis C of the drive shaft 4.

The outer protruding portion 49 is provided at a lower end portion of the cylindrical portion 46. The outer protruding portion 49 extends radially outward from the lower end portion of the cylindrical portion 46. A through hole 59 through which a bolt of the regulating portion 44 which will be described later is inserted is formed in the outer protruding portion 49. The through hole 59 penetrates the outer protruding portion 49 in an axial direction of the drive shaft 4.

The second member 42 is fixed to the lower case 8. The second member 42 is formed in a cylindrical shape centered on the axis C. The second member 42 is attached to an upper portion of the lower case 8 and protrudes upward (toward a side of the upper case 2) from the lower case 8. The second member 42 has a main body portion 51, a flange 52, and a second screw portion 53.

The main body portion 51 is formed in a cylindrical shape coaxial with an axis C of the drive shaft 4. The drive shaft 4 is inserted into the main body portion 51 at a distance from an inner peripheral surface of the main body portion 51. An upper portion of the main body portion 51 is inserted into the cylindrical portion 46 of the first member 41 from below. The flange 52 is provided at a lower end portion of the main body portion 51.

The flange 52 extends from the lower end portion of the main body portion 51 toward an outer side in the radial direction of the main body portion 51. The flange 52 is attached to the lower case 8 not to rotate relative to the lower case 8 by a fastening member such as a bolt.

The second screw portion 53 is formed on an outer peripheral surface of the upper portion of the main body portion 51. The second screw portion 53 is a male screw that is screwed to the first screw portion 48 of the first member 41. When the first screw portion 48 and the second screw portion 53 are screwed to each other, the first member 41 and the second member 42 are connected to each other. Further, when the first member 41 and the second member 42 are connected to each other, the upper case 2 and the lower case 8 are connected to each other. When the first member 41 rotates about the axis C with respect to the second member 42, a distance between the first member 41 and the second member 42 is relatively displaced in the axial direction by a screw mechanism including the first screw portion 48 and the second screw portion 53.

Figure 3:
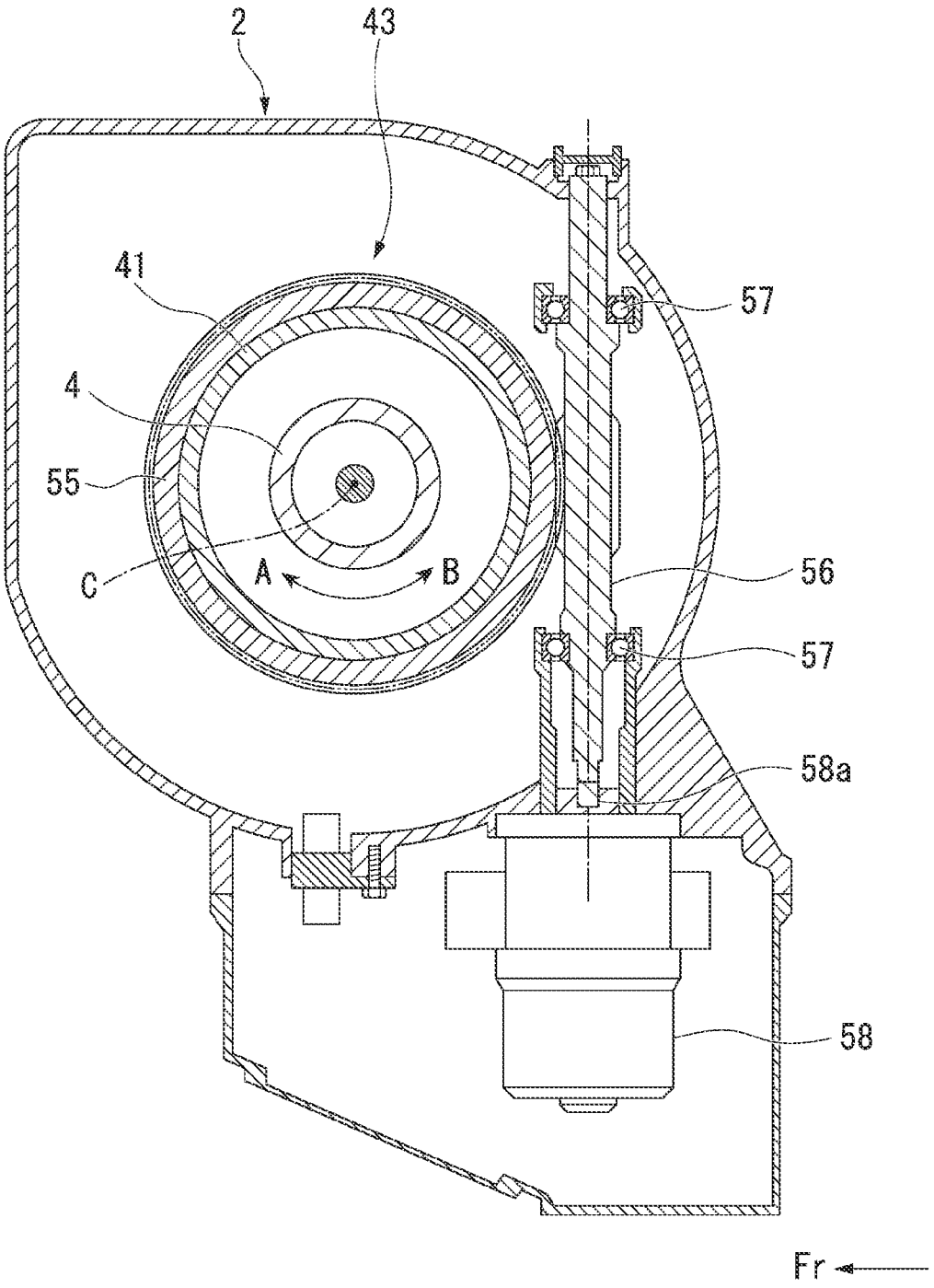
FIG. 3 is a cross-sectional view along line of FIG. 2.

FIG. 3 is a cross-sectional view along line of FIG. 2.

As shown in FIGS. 2 and 3, the rotation device 43 rotates the first member 41 around the axis C. The rotation device 43 has a worm wheel 55, a worm 56, and a motor 58 (see FIG. 3). The worm wheel 55, the worm 56, and the motor 58 are accommodated in the upper case 2.

For example, the worm wheel 55 is disposed coaxially with the drive shaft 4 and is fixed to an outer peripheral surface of the first member 41. The worm wheel 55 rotates the first member 41 by being rotated. The worm 56 is meshed with a rear end portion of the worm wheel 55.

As shown in FIG. 3, the worm 56 extends in a direction intersecting the forward-rearward direction (that is, in the leftward-rightward direction) and in a horizontal direction. The worm 56 is rotatably supported by the upper case 2 via, for example, a pair of bearings 57. One end portion of the worm 56 is connected to a rotation shaft 58*a* of the motor 58.

Therefore, when the motor 58 is driven, the worm 56 can be rotated. When the worm 56 is rotated, the worm wheel 55 can be rotated by the worm 56. When the worm wheel 55 is rotated, the first member 41 can be rotated in a direction of arrow A-B about the axis C of the drive shaft 4. The worm 56 and the motor 58 in the rotation device 43 are the same as (in common use for) a worm and a motor in a turning unit (not shown) that changes a direction of the propeller 7 for steering the outboard motor 1, for example.

The height adjusting unit 9 formed in this way changes a relative height between the first member 41 and the second member 42 by converting rotational motion of the first member 41 into up and down motion in the vertical direction with the above-described rotation device 43, first screw portion 48 (the screw portion), and second screw portion 53. Specifically, for example, in a case where the first member 41 is rotated in a direction of arrow A by the rotation device 43, the second member 42 moves downward with respect to the first member 41. For example, in a case where the first member 41 is rotated in a direction of arrow B by the rotation device 43, the second member 42 moves upward with respect to the first member 41. As a result, a relative height between the upper case 2 and the lower case 8 changes. Here, since the upper case 2 is attached to the hull 12, "a relative height between the upper case 2 and the lower case 8 changes" means that a height position of the lower case 8 with respect to the hull 12 changes. When the height position of the lower case 8 changes, a height position of the propeller 7 with respect to the hull 12 changes.

As shown in FIG. 2, the regulating portion 44 restricts and allows relative rotation between the first member 41 and the second member 42. In the present embodiment, the regulating portion 44 is a bolt that fastens the first member 41 and the second member 42 to each other. The regulating portion 44 (the bolt) is inserted into the through hole 59 provided in the outer protruding portion 49 of the first member 41. The regulating portion 44 restricts the relative rotation between the first member 41 and the second member 42 by fastening and fixing the outer protruding portion 49 of the first member 41 and the flange 52 of the second member 42 to each other. On the other hand, when the bolt is removed, the regulating portion 44 allows the relative rotation between the first member 41 and the second member 42 and enables the height adjustment of the lower case 8. When the lower case 8 is adjusted to be at a desired height with respect to the hull 12 and then the rotation is restricted by the regulating portion 44, the height position of the lower case 8 can be fixed (maintained) at a desired height.

Operations and Effects

Next, operations and effects of the above-described outboard motor 1 will be described.

According to the outboard motor 1 of the present embodiment, the outboard motor 1 has the height adjusting unit 9 that adjusts a height position between the upper case 2 and the lower case 8 in the vertical direction. The height adjusting unit 9 includes the first member 41, the second member 42, the rotation device 43, and the regulating portion 44. The first member 41 is rotatably supported around the axis C of the drive shaft 4 with respect to one of the upper case 2 and the lower case 8 and has a screw portion (a first screw portion 48) coaxial with the drive shaft 4. The second member 42 is fixed to the other of the upper case 2 and the lower case 8 and is screwed to the first screw portion 48 of the first member 41. When the rotation device 43 operates, the first member 41 rotates relative to the second member 42 in a state where the first screw portion 48 of the first member 41 and the second member 42 are screwed to each other. At this time, the rotational force of the first member 41 is converted into the up and down motion along the axis C by the screw mechanism, and the second member 42 moves in the axial direction with respect to the first member 41. As a result, the height position between the upper case 2 and the lower case 8 in the vertical direction changes, and thus the height position of the propeller 7 can be adjusted. Since the first member 41 is configured to rotate coaxially with the drive shaft 4, the height position of the propeller 7 can be adjusted without changing a trim angle. Since the rotational force is converted into a reciprocating motion in the upward-downward direction by the screw mechanism, the height position of the propeller 7 can be finely adjusted to a desired height as compared with a slide type height adjusting unit of the related art. After the adjustment of the height position is completed, the height position can be fixed by restricting the relative rotation between the first member 41 and the second member 42 with the regulating portion 44.

Therefore, it is possible to provide the outboard motor 1 capable of adjusting the height position of the propeller 7 with high accuracy without changing the trim angle.

The height adjusting unit 9 changes a relative height between the first member 41 and the second member 42 by converting rotational motion of the first member 41 into up and down motion in the vertical direction with the screw portion (the first screw portion 48 and the second screw portion 53). As a result, the relative height between the upper case 2 and the lower case 8 can be changed. Therefore, the height position of the propeller 7 can be adjusted to a desired height by the screw mechanism.

The rotation device 43 has the worm wheel 55 and the worm 56. The worm wheel 55 is disposed coaxially with the drive shaft 4. The worm 56 is meshed with the worm wheel 55 and is connected to the motor 58. As a result, when the worm 56 is rotated by the motor 58, the worm wheel 55 can be rotated by the worm 56. Therefore, the height position of the propeller 7 can be adjusted with high accuracy by rotating the first member 41 around the drive shaft 4.

The regulating portion 44 is a bolt that fastens the first member 41 and the second member 42 to each other. When the first member 41 and the second member 42 are fastened to each other by the bolt, the relative rotation between the first member 41 and the second member 42 can be restricted. Therefore, when the height of the propeller 7 is adjusted to a desired position and then the first member 41 and the second member 42 are fastened to each other by the bolt, the height of the propeller 7 can be fixed. When adjusting the height of the propeller 7, the height can be adjusted again simply by removing the bolt. Since the relative rotation between the first member 41 and the second member 42 can be restricted by the bolt, the regulating portion 44 can have a simple configuration.

The worm 56 and the motor 58 in the rotation device 43 are the same as (in common use for) a worm and a motor in a turning unit (not shown) that changes a direction of the propeller 7 for steering the outboard motor 1. Therefore, for example, in a case where the motor 58 is driven in a state where the first member 41 and the second member 42 are fixed to each other by the regulating portion 44, the first member 41 and the lower case 8 can be integrally rotated with each other. That is, by rotating the worm wheel 55, it is possible to change a direction of the propeller 7 and to perform turning. Therefore, the layout of the outboard motor 1 can be simplified and the increase in cost and weight can be suppressed.

Second Embodiment

Figure 4:
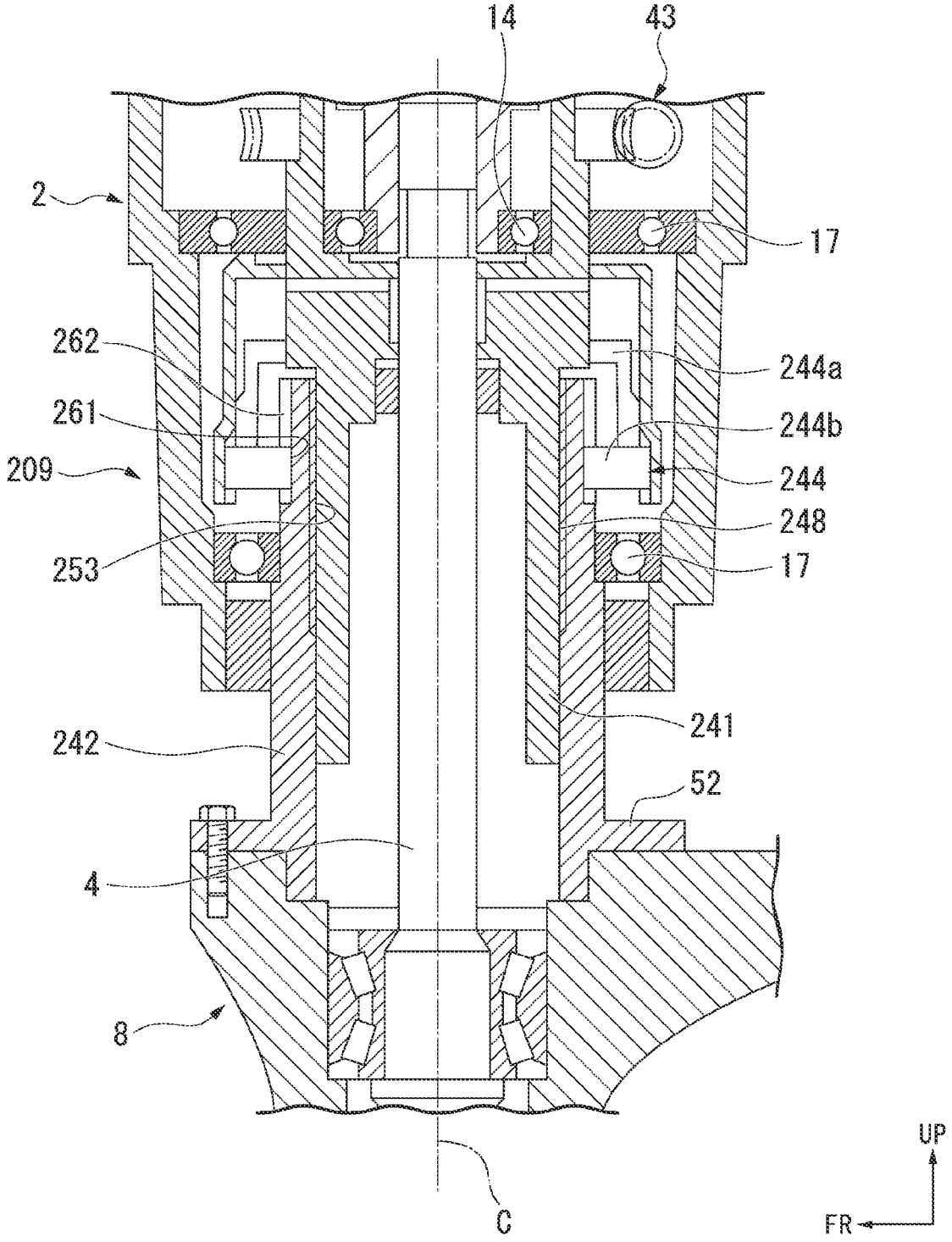
FIG. 4 is an enlarged cross-sectional view of a height adjusting unit of an outboard motor according to a second embodiment.

Next, a second embodiment according to the present invention will be described. FIG. 4 is an enlarged cross-sectional view of a height adjusting unit 209 of an outboard motor 1 according to a second embodiment. In the following description, the same constituent elements as those in the above-described first embodiment are designated by the same reference signs, and detailed description thereof will be omitted as appropriate. The present embodiment is different from the above-described first embodiment in that the first member 41 is inserted into the second member 42 and the regulating portion 44 is a clutch.

In the present embodiment, a male screw coaxial with the axis C is formed as a first screw portion 248 in an outer peripheral surface of a first member 241. A female screw coaxial with the axis C is formed as a second screw portion 253 in an inner peripheral surface of a second member 242. The first member 241 is inserted into the second member 242 from above. The first screw portion 248 formed in the outer peripheral surface of the first member 241 and the second screw portion 253 formed on the inner peripheral surface of the second member 242 are screwed to each other.

In the present embodiment, the regulating portion 244 is a clutch that is attached to the first member 241 and engages with the second member 242 to make the second member 242 non-rotatable. The regulating portion 244 (the clutch) is accommodated in the upper case 2. One end portion 244*a* of the regulating portion 244 is fixed to the first member 241. The other end portion 244*b* of the regulating portion 244 has a claw portion 261 that engages with an outer peripheral portion of the second member 242. A plurality of grooves 262 with which the claw portion 261 can engage are formed in an outer peripheral surface of the second member 242 over the entire circumference in a circumferential direction.

When the clutch 244 is turned on, the claw portion 261 of the clutch 244 engages with the groove 262 of the second member 242, and thus relative rotation between the first member 241 and the second member 242 is restricted. On the other hand, when the clutch 244 is turned off, the claw portion 261 is separated from the groove 262 and the engaged state is released, and thus the relative rotation between the first member 241 and the second member 242 is allowed.

According to the present embodiment, the first screw portion 248 is formed on the outer peripheral surface of the first member 241, and the second screw portion 253 is formed on the inner peripheral surface of the second member 242. When the first member 241 is inserted into and the second member 242, the first screw portion 248 and the second screw portion 253 are screwed to each other. As described above, even in a case where the screwing relationship between the first member 241 and the second member 242 in the radial direction is reversed as compared with the first embodiment, the same effect as that of the first embodiment can be obtained. That is, when the first member 241 is rotated by the rotation device 43, the relative position between the first member 241 and the second member 242 in the axial direction changes. Therefore, the height position of the lower case 8 with respect to the hull 12 can be adjusted.

The regulating portion 244 is a clutch that is attached to the first member 241 and engages with the second member 242 to make the second member 242 non-rotatable. By turning on and off of the clutch 244, the height of the propeller 7 can be adjusted and fixed. Since the clutch 244 can be electrically controlled, the workability related to the height adjustment of the propeller 7 can be improved as compared with a case where a bolt or the like for restricting the relative rotation between the first member 241 and the second member 242 is provided, for example.

The technical scope of the present invention is not limited to the above-described embodiments, and various modifications can be made without departing from the spirit of the present invention.

For example, in the example shown in FIG. 1, a rotation shaft (the axis C) of the drive shaft 4 and the rotation shaft 21 of the drive motor 18 are disposed side by side in the forward-rearward direction, but the present invention is not limited to this. The drive motor 18 may be disposed above the drive shaft 4. That is, the drive shaft 4 and the drive motor 18 may be provided coaxially.

The drive shaft 4 is configured to have the expansion and contraction portion 27 that expands and contracts in the upward-downward direction with the movement of the lower case 8 with respect to the upper case 2, but the present invention is not limited to this. For example, the drive shaft 4 may be configured to be slidable in the upward-downward direction with respect to the upper case 2 (the first member 41) instead of having the expansion and contraction portion 27. In this case, the drive shaft 4 may slide with respect to the upper case 2 (the first member 41), and thus the movement of the lower case 8 with respect to the upper case 2 in the upward-downward direction is allowed.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

EXPLANATION OF REFERENCES

1 Outboard motor
2 Upper case
4 Drive shaft
6 Propeller shaft
7 Propeller
8 Lower case
9, 209 Height adjusting unit
12 Hull
18 Drive motor (drive source)
41, 241 First member
42, 242 Second member
43 Rotation device
44, 244 Regulating portion
55 Worm wheel
56 Worm
58 Motor
C Axis

What is claimed is:

1. An outboard motor that propels a hull by rotating a propeller with a drive source, comprising:

a drive shaft that is connected to the drive source and extends in a vertical direction;

a propeller shaft that is connected to a lower end portion of the drive shaft to intersect the drive shaft and is provided with the propeller;

an upper case that accommodates the drive source;

a lower case that accommodates the propeller shaft; and a height adjusting unit that adjusts a height position between the upper case and the lower case in the vertical direction, wherein the height adjusting unit includes a first member that is disposed coaxially with an axis of the drive shaft, is rotatably supported around the axis with respect to one of the upper case and the lower case, and has a screw portion coaxial with the axis, a second member that is fixed to the other of the upper case and the lower case and is screwed to the screw portion of the first member, a rotation device that rotates the first member, and a regulating portion that restricts and allows relative rotation between the first member and the second member.

2. The outboard motor according to claim 1, wherein the height adjusting unit changes a relative height between the first member and the second member by converting rotational motion of the first member into up and down motion in the vertical direction with the screw portion.

3. The outboard motor according to claim 1, wherein the rotation device includes a worm wheel that is disposed coaxially with the drive shaft and rotates the first member by being rotated, and a worm that is meshed with the worm wheel and is connected to a motor.

4. The outboard motor according to claim 1, wherein the regulating portion is a bolt that fastens the first member and the second member to each other.

5. The outboard motor according to claim 1, wherein the regulating portion is a clutch that is attached to the first member and engages with the second member to make the second member non-rotatable.

6. The outboard motor according to claim 3, wherein the worm of the rotation device is the same as a worm in a turning unit that changes a direction of the propeller for steering the outboard motor.

* * * * *